US010538952B2

(12) United States Patent
Rosende et al.

(10) Patent No.: US 10,538,952 B2
(45) Date of Patent: Jan. 21, 2020

(54) CLIP FASTENER SYSTEM FOR A WINDOW

(71) Applicant: Deco Flash, LLC, Tampa, FL (US)

(72) Inventors: John Leonard Rosende, Tampa, FL (US); Christopher Ryan Rosende, Tampa, FL (US)

(73) Assignee: Deco Flash, LLC, Tampa, FL (US)

( * ) Notice: Subject to any disclaimer, the term of this patent is extended or adjusted under 35 U.S.C. 154(b) by 0 days.

(21) Appl. No.: 15/969,825

(22) Filed: May 3, 2018

(65) Prior Publication Data

US 2018/0252020 A1 Sep. 6, 2018

Related U.S. Application Data

(63) Continuation of application No. 14/831,915, filed on Aug. 21, 2015, now abandoned.

(51) Int. Cl.

| | |
|---|---|
| ***E06B 1/60*** | (2006.01) |
| ***E06B 1/62*** | (2006.01) |
| ***E06B 1/68*** | (2006.01) |

(52) U.S. Cl.

CPC ..... *E06B 1/6053* (2013.01); *E06B 1/68* (2013.01); *E06B 2001/628* (2013.01)

(58) Field of Classification Search

CPC .... E06B 1/6053; E06B 1/6046; E06B 1/6061; E06B 3/5821; E06B 1/36; E06B 1/68; E06B 2001/628

USPC .... 52/213, 215, 204.1, 204, 204.62, 204.53, 52/208, 214, 718.01, 718.04, 718.05, 718, 52/718.03, 717.01

See application file for complete search history.

(56) References Cited

U.S. PATENT DOCUMENTS

| | | | | |
|---|---|---|---|---|
| 2,840,202 A | | 6/1958 | Hehr | |
| 2,840,203 A | | 6/1958 | Hehr | |
| 4,525,966 A | * | 7/1985 | Litchfield | E06B 3/5821 52/204.591 |
| 5,083,409 A | * | 1/1992 | Pliml, Jr. | E06B 3/44 403/297 |
| 5,245,788 A | | 9/1993 | Riegelman | |
| 5,355,651 A | | 10/1994 | Correia | |
| 5,560,149 A | | 10/1996 | Lafevre | |

(Continued)

FOREIGN PATENT DOCUMENTS

| | | | | |
|---|---|---|---|---|
| CA | 1214962 A | * | 12/1986 | E06B 3/5821 |
| GB | 2031979 A | * | 4/1980 | B60J 1/001 |
| WO | 2009069080 | | 8/2009 | |

OTHER PUBLICATIONS

Machine translation of foreign reference CA1214962, obtained from http://translationportal.epo.org/emtp/translate/?ACTION=description-retrieval&COUNTRY=CA&ENGINE=google&FORMAT=docdb&KIND=A&LOCALE=en_EP&NUMBER=1214962&OPS=ops.epo.org/3.2&SRCLANG=fr&TRGLANG=en (last accessed on Apr. 11, 2019) (Year: 2019).*

*Primary Examiner* — Theodore V Adamos
(74) *Attorney, Agent, or Firm* — Maxey-Fisher, PLLC; Brittany J. Maxey-Fisher

(57) ABSTRACT

A clip fastening system for securing a window in a window opening without the use of penetrating fasteners is disclosed. The clip fastening system includes a flange that extends in an inward direction from and around the window opening, a groove that is formed through a facing of a window frame of the window and that extends around the perimeter of the window frame, and a clip mutually engaged with the flange and the groove, thereby securing the window frame within the window opening.

10 Claims, 3 Drawing Sheets

(56) References Cited

U.S. PATENT DOCUMENTS

| | | | | |
|---|---|---|---|---|
| 5,619,828 | A * | 4/1997 | Ver Meer | E06B 1/6015 29/897.312 |
| 6,173,541 | B1 * | 1/2001 | Petta | E06B 1/02 52/204.5 |
| 6,786,453 | B2 | 9/2004 | Jones | |
| 7,162,841 | B2 * | 1/2007 | Kownacki | E06B 1/6053 403/382 |
| 7,454,865 | B2 | 11/2008 | Kerscher | |
| 7,490,442 | B1 * | 2/2009 | Jackson | E04G 15/02 52/214 |
| 7,654,046 | B2 | 2/2010 | Ellingson | |
| 7,823,833 | B2 | 11/2010 | Wood | |
| 7,958,682 | B2 | 6/2011 | Elzein | |
| 8,245,462 | B2 | 8/2012 | Miethe | |
| 8,448,394 | B2 | 5/2013 | Miethe | |
| 8,550,140 | B2 * | 10/2013 | Kelley | E06B 3/28 160/90 |
| 2002/0078640 | A1 * | 6/2002 | Petta | E06B 1/34 52/204.1 |
| 2009/0044466 | A1 * | 2/2009 | Andres | E04F 19/02 52/204.53 |
| 2009/0193728 | A1 | 8/2009 | Butler | |
| 2010/0251644 | A1 | 10/2010 | Quesada | |
| 2011/0047875 | A1 * | 3/2011 | Kelley | E06B 3/28 49/63 |

* cited by examiner

CLIP FASTENER SYSTEM FOR A WINDOW

CROSS-REFERENCE TO RELATED APPLICATIONS

This application is a continuation of U.S. application Ser. No. 14/831,915, filed Aug. 21, 2015, the entirety of which is incorporated herein by reference.

FIELD OF THE INVENTION

The present invention relates generally to windows, and more particularly, relating to clip fastener system for securing a window in a window opening without using penetrating fasteners.

BACKGROUND OF THE INVENTION

Prefabricated windows are conventionally installed in a window opening that is formed through a wall section of a building by using penetrating fasteners such as nails and screws that are nailed or screwed through the window frame and into the building structure that forms the window opening. While the use of penetrating fasteners securely fastens the window, using penetrating fasteners presents several problems.

One problem is that penetrating fasteners are unsightly and detract from the finish of the installed window. Another problem is the penetrating fasteners create holes through the window frame and the surrounding building structure, which provides the opportunity for undesirable water intrusion. Accordingly, there is a need and desire for a new way to secure windows in window openings that overcomes these and other inherent problems with current window installation systems and methods.

SUMMARY OF THE INVENTION

In view of the foregoing problems with conventional window fastening systems and methods, embodiments of the present invention provide a clip fastening system to secure a window in a window opening that overcomes the existing problem.

In general, in one aspect, a clip fastening system for securing a window is provided. The system includes a frame having a front end, a back end, an interior wall defining a window opening that extends between the front end and the back end, and a flange disposed at the back end. The flange extends perpendicularly from the interior wall in an inwardly direction therefrom and around the window opening. The frame is disposed within a rough opening formed in a wall of a building. A window has a window frame removably disposed within the window opening in a direction from the front end toward the back end of the frame. The window frame has a groove formed through an outward facing of the window frame and extending around the perimeter of said window frame and has an opening facing the flange of the frame. A clip has a C-channel defined by a first leg and a second leg connected together in a spaced apart, parallel extending relationship by a web, and a barb extending outwardly from an outward face of the first leg. The window frame is secured within the window opening without using penetrating fasteners by the clip mutually engaged with the flange of the frame and the groove of the window frame, with the barb disposed within the groove and the flange disposed within the C-channel, with the second leg extend along and overlapping the back end of the frame, and with the first leg disposed between and in contact with the outward facing of the window and the flange.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
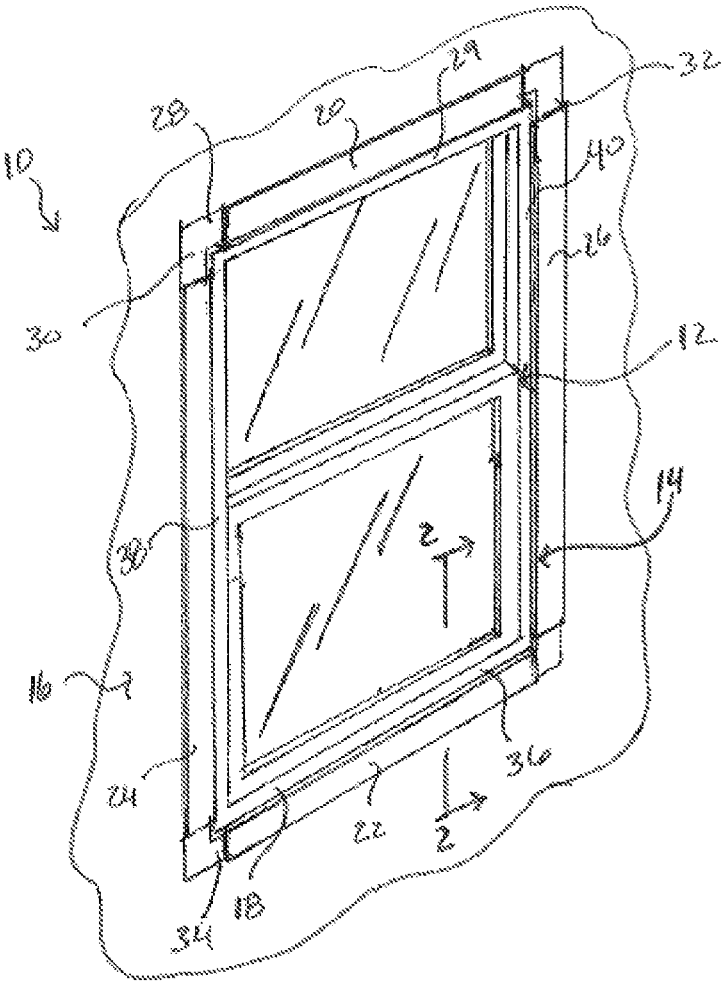
FIG. 1 is a perspective view of a clip fastening system constructed in accordance with the principles of an embodiment of the present invention, shown in-use in conjunction with a window that is secured in a window opening by the clip fastening system.

Referring now to the drawings, and more particularly to FIGS. 1-5, diagrammatically shown therein and designated by the reference number 10 is an embodiment of the present clip fastener system for a window.

In FIG. 1, the clip fastener system 10 is shown in-use and in conjunction with window 12 that is secured within window opening 14 in wall section 16 by the clip fastener system. As depicted, window frame 18 of window 12 is secured in the window opening 14 by a head clip 20, a sill clip 22, and opposite jam clips 24 and 26, which are arranged around the window frame and window opening.

As further described below, head clip 20 mutually engages the header 28 of the window opening 14 and the head 29 of the window frame 18 and extends along their lengths between the jams 30 and 32. Sill clip 22 mutually engages the sill 34 of the window opening 14 and the sill 36 of the window frame 18 and extends along their lengths between the jams 30 and 32. Jam clip 24 mutually engages the jam 38 of window frame 18 and jam 30 of window opening 14 and extends along their lengths between the header 28 and sill 34. Similarly, jam clip 26 mutually engages the jam 40 of the window frame and jam 32 of the window opening 14 and extends along their lengths between the header 28 and sill 34.

Figure 2:
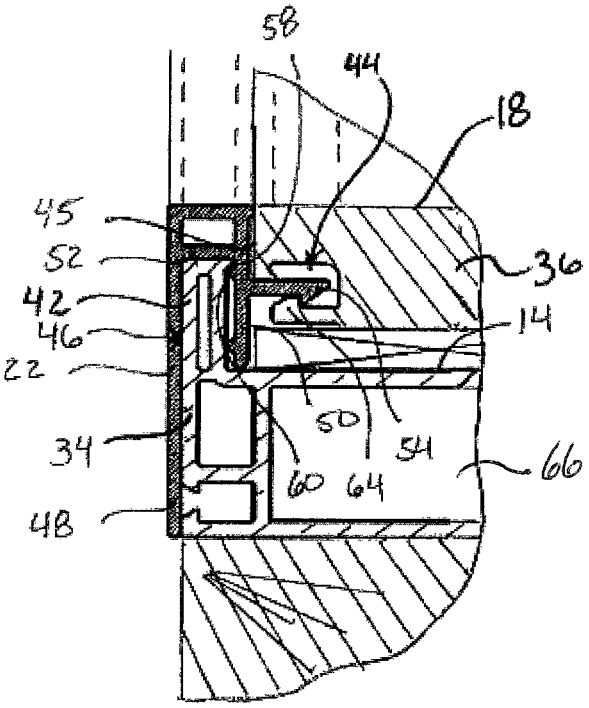
FIG. 2 is an enlarged, fragmented cross-sectional view taken along line 2-2 in FIG. 1.

Turning to FIG. 2, there is shown an enlarged fragmented sectional view of sill 36 of the window frame 18 secured to the sill 34 of the window opening 14 by sill clip 22. As depicted, the window opening includes a flange 42 that extends a direction inwardly from and around the window opening. Window frame 18 includes a groove 44 formed through facing 45 that extends around the perimeter of the window frame. Groove 44 opens in a direction generally perpendicular to the flange 42 through facing 45 that is disposed generally parallel to the flange. Clip 22 is configured to engage flange 42 and groove 44, thereby securing the window frame 18 in the window opening 14.

In the illustrated embodiment, clip 22 includes a C-channel 46 that is defined by legs 48 and 50 that are connected together in a spaced apart, parallel extending relationship by a web 52. Clip 22 further includes a barb 54 that extends outwardly from outward face 56 of leg 50 in a direction that is generally perpendicular to leg 50. Clip 22 is mutually engaged with sill 34 of window open 14 and sill 36 of window frame 18 by inserting flange 42 into the channel 46 of the clip and by barb 54 into groove 44.

Flange 42 is restrained against withdrawing from channel 46 by lip 58 formed along the inward free edge of the flange and beads 60 formed along the inward face 62 of leg 50. Barb 54 is restrained against withdrawing from groove 44 by the barb engaging with lip 64 formed along a free edge of the groove.

It is important to note and understand that while the foregoing description was made in reference to the sill clip 22 and its engagement with sill 34 of window opening 14 and the sill 36 of window frame 18, clips 20, 24, and 26 have the same construction and engage the other sides of the window opening and window frame in the same manner. Thus, the foregoing description also pertains to clips 20, 24, and 26.

Figure 3:
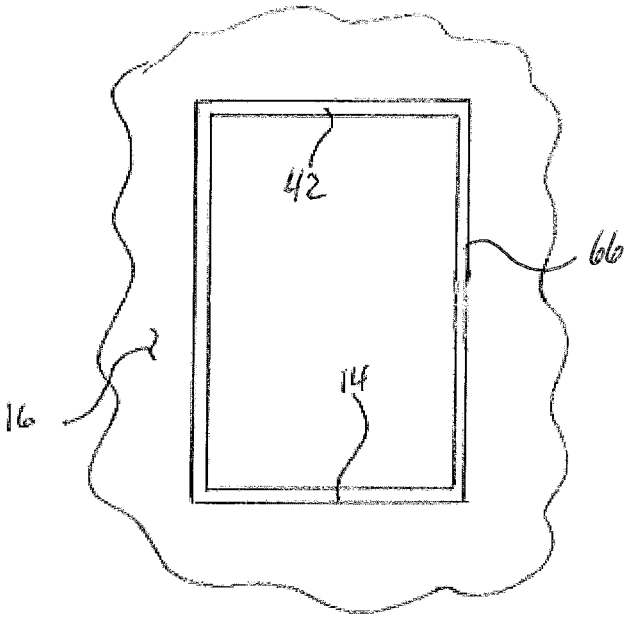
FIG. 3 is an elevation view of a window opening constructed in accordance with the principles of an embodiment of the present invention.

With reference to FIG. 3, there is shown an elevation view of the window opening 14 formed through wall 16 and flange 42 that extends a direction inwardly from and around the window opening.

Figure 4:
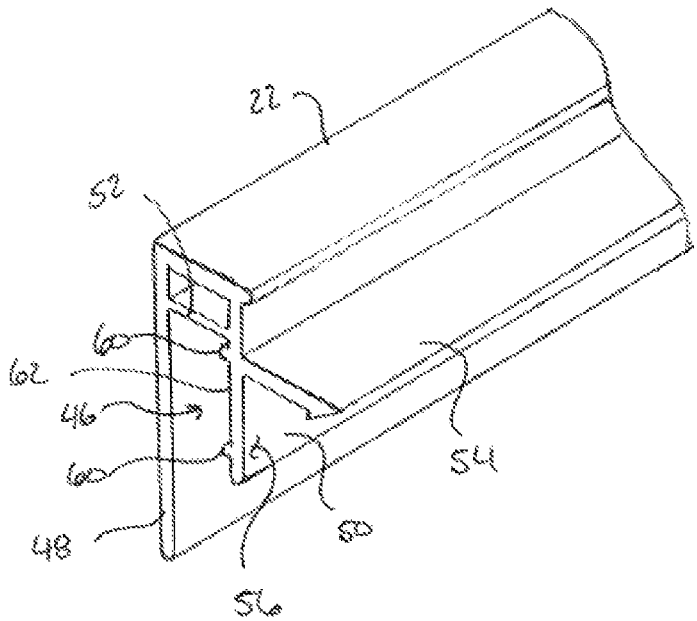
FIG. 4 is a perspective view of a clip element of a clip fastening system constructed in accordance with the principals of an embodiment of the present invention.

With reference to FIG. 4, there is shown a fragmented perspective view of clip 22, which has an identical construction as clips 20, 24, and 26. Clip 22 is an elongated, extruded member constructed of plastic, vinyl, or other suitable material. Clip 22 can be provided in standardized lengths and then trimmed or cut to size for a particular application depending on the dimensions of the window. As depicted, clip 22 includes C-channel 46 that is defined by legs 48 and 58 that are connected together in a spaced apart, parallel extending relationship by a web 52. Barb 54 extends outwardly from outward face 56 of leg 50 in a direction that is generally perpendicular to leg 50 and runs continuously along the length of the clip. Beads 60 are formed along the inward face 62 of leg 50 and also run continuously along the length of the clip.

Figure 5:
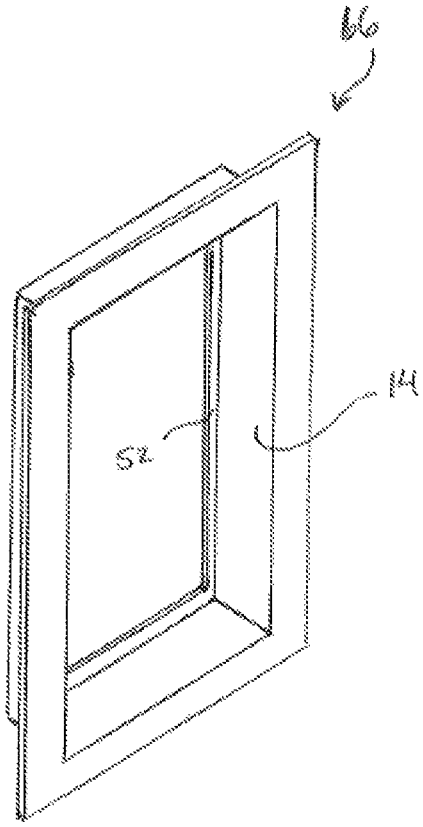
FIG. 5 is a perspective view a frame for providing a window opening constructed in accordance with the principals of an embodiment of the present invention.

Turning now to FIG. 5, in certain aspects, the window opening 14 can be provided by frame 66 that is configured to be installed into a rough opening formed in a wall section. As representatively illustrated, frame 66 can be provided as a single-piece unit that has a waterproof construction. In certain aspects, frame 66 may be constructed of several individual frame members that are connected together to form a single-piece unit. In this construction, the frame members are connected together such that the seams are waterproof. The frame members may be connected together to form waterproof seams by methods such as bonding, welding, gluing, for example.

In view of the foregoing description, it becomes readily apparent the present clip fastener system for a window provides for a simple, rapid, and secure fastening of a window in a window opening without using penetrating fasteners. Accordingly, the present clip fastener system securely fastens a window without impairing the integrity of the window frame and the window opening. Once the window is secured by the present clip fastening system, the window can be sealed by running a bead of caulking, sealant, or the like around the interface between the window frame and the window opening.

A number of embodiments of the present invention have been described. Nevertheless, it will be understood that various modifications may be made without departing from the spirit and scope of the invention. Accordingly, other embodiments are within the scope of the following claims.

What is claimed is:

1. A clip fastening system for securing a window, the system comprising:

a frame having a front end, a back end, an interior wall defining a window opening extending between the front end and the back end, and a flange disposed at the back end, said flange extending perpendicularly from the interior wall in an inwardly direction therefrom and around the window opening, said frame disposed within a rough opening formed in a wall of a building;

a window having a window frame removably disposed within the window opening in a direction from the front end toward the back end of the frame, said window frame having a groove formed through an outward facing of said window frame and extending around the perimeter of said window frame, said groove having an opening facing the flange of the frame;

a clip having a C-channel defined by a first leg and a second leg connected together in a spaced apart, parallel extending relationship by a web, and a barb extending outwardly from an outward face of the first leg; and wherein the window frame is secured within the window opening without using penetrating fasteners by the clip mutually engaged with the flange of the frame and the groove of the window frame, with the barb disposed within the groove and the flange disposed within the C-channel, with the second leg extending along and overlapping the back end of the frame, and with the first leg disposed between and in contact with the outward facing of the window and the flange.

2. The system of claim 1, wherein the clip further includes a bead formed on an inward facing of the first leg that engages with a lip formed along an inward edge of the flange to prevent the flange from being withdrawn from the C-channel.

3. The system of claim 1, wherein the clip is elongated, and the barb extends continuously along the entire length of the clip.

4. The system of claim 1, wherein the flange extends continuously around the window opening.

5. A clip fastening system for securing a window, the system comprising:

a frame having a front end, a back end, an interior wall defining a window opening extending between the front end and the back end, and a flange disposed at the back end, said flange extending perpendicularly from the interior wall in an inwardly direction therefrom and continuously around the window opening, said frame disposed within a rough opening formed in a wall of a building;

a window having a window frame removably disposed within the window opening in a direction from the front end toward the back end of the frame, said window frame having a groove formed through an outward facing of said window frame and extending around the perimeter of said window frame, said groove having an opening facing the flange of the frame;

a clip having a C-channel defined by a first leg and a second leg connected together in a spaced apart, parallel extending relationship by a web, and a barb extending outwardly from an outward face of the first leg;

wherein the window frame is secured within the window opening without using penetrating fasteners by the clip mutually engaged with the flange of the frame and the groove of the window frame, with the barb disposed within the groove and the flange disposed within the C-channel, with the second leg extending along and overlapping the back end of the frame, and with the first leg disposed between and in contact with the outward facing of the window and the flange; and wherein the clip further includes a bead formed on an inward facing of the first leg that engages with a lip formed along an inward edge of the flange to prevent the flange from being withdrawn from the C-channel, the clip is elongated, and the barb extends continuously along the entire length of the clip.

6. A clip fastening system for securing a window, the system comprising:

a frame having a front end, a back end, an interior wall defining a window opening extending between the front end and the back end, and a flange disposed at the back end, said flange extending perpendicularly from the interior wall in an inwardly direction therefrom and around the window opening, said frame disposed within a rough opening formed in a wall of a building;

a window having a window frame removably disposed within the window opening in a direction from the front end toward the back end of the frame, said window frame having a groove formed through an outward facing of said window frame and extending around the perimeter of said window frame, said groove having an opening facing the flange of the frame;

a plurality of clips, each having a C-channel defined by a first leg and a second leg connected together in a spaced apart, parallel extending relationship by a web, and a barb extending outwardly from an outward face of the first leg; and wherein the window frame is secured within the window opening without using penetrating fasteners by each clip of the plurality of clips mutually engaged with the flange of the frame and the groove of the window frame, with the barb of each clip disposed within the groove and the flange disposed within the C-channel, with the second leg of each clip extending along and overlapping the back end of the frame, and with the first leg of each clip disposed between and in contact with the outward facing of the window and the flange.

7. The system of claim 6, wherein the plurality of clips includes a head clip, a sill clip, and a pair of jamb clips, wherein the head clip mutually engages the flange and groove along a header of the window opening and a head of the window frame, wherein the sill clip mutually engages the flange and groove along a sill of the window opening and a sill of the window frame, wherein a first jamb clip mutually engages the flange and groove along a first jamb of the window opening and a corresponding first jamb of the window frame, and wherein a second jamb clip mutually engages the flange and groove along a second jamb of the window opening and a corresponding second jamb of the window frame.

8. The system of claim 6, wherein each clip of the plurality of clips further includes a bead formed on an inward facing of the first leg that engages with a lip formed along an inward edge of the flange to prevent the flange from being withdrawn from the C-channel.

9. The system of claim 6, wherein each clip of the plurality of clips is elongated, and the barb extends continuously along the entire length of the clip.

10. The system of claim 6, wherein the flange extends continuously around the window opening.

* * * * *